US006131355A

United States Patent [19]

Groh et al.

[11] Patent Number: 6,131,355

[45] **Date of Patent: *Oct. 17, 2000**

[54] DECK PLANK

[75] Inventors: A. Anthony Groh, Columbus; Philip H. Stobart, Worthington, both of Ohio

[73] Assignee: Crane Plastics Company Limited Partnership, Columbus, Ohio

[ * ] Notice: This patent is subject to a terminal disclaimer.

[21] Appl. No.: 09/009,283

[22] Filed: Jan. 20, 1998

Related U.S. Application Data

[63] Continuation-in-part of application No. 08/752,813, Nov. 21, 1996, Pat. No. 5,836,128.

[51] Int. Cl.[7] ..... E04C 3/00

[52] U.S. Cl. ..... 52/592.1; 52/314; 52/578; 52/650.3; 52/745.05

[58] Field of Search ..... 52/177, 309.1, 52/314, 483.1, 578, 580, 581, 592.1, 604, 605, 650.3, 745.06, 745.05, 745.13, 747.1, 731.7, 764, 765, 775, 780, DIG. 7

[56] References Cited

U.S. PATENT DOCUMENTS

| | | | |
|---|---|---|---|
| 329,616 | 11/1885 | Baldwin | 52/578 |
| 502,289 | 8/1893 | Feldmann | 52/578 |
| 1,374,082 | 4/1921 | Hedges | 52/578 |
| 1,433,896 | 10/1922 | Lord | 52/578 |
| 1,551,544 | 9/1925 | Crooks | 52/578 |
| 1,952,536 | 3/1934 | Crooks | 52/578 |
| 2,186,684 | 1/1940 | Ritter | 52/314 X |
| 2,947,040 | 8/1960 | Schultz | 52/578 X |
| 3,386,221 | 6/1968 | Giovannucci | 52/578 |
| 4,241,133 | 12/1980 | Lund et al. | 428/326 |
| 4,376,144 | 3/1983 | Goettler | 428/36 |
| 4,526,418 | 7/1985 | Martin | 52/483.1 X |
| 5,033,147 | 7/1991 | Svensson | 52/747.1 |
| 5,351,915 | 10/1994 | Aandalen | 52/483.1 X |
| 5,410,855 | 5/1995 | Clausen et al. | 52/747.1 |
| 5,411,782 | 5/1995 | Jarvis et al. | 52/580 X |
| 5,516,472 | 5/1996 | Laver | 264/118 |
| 5,836,128 | 11/1998 | Groh et al. | 52/580 |

FOREIGN PATENT DOCUMENTS

| | | |
|---|---|---|
| 93306843 | 8/1993 | European Pat. Off. . |
| 93306845 | 8/1993 | European Pat. Off. . |

*Primary Examiner*—Carl D. Friedman
*Assistant Examiner*—Kevin D. Wilkens
*Attorney, Agent, or Firm*—Standley & Gilcrest LLP

[57] ABSTRACT

A deck plank comprising a substantially flat top surface made preferably from a wood replacement material having a first edge and a second edge, and may also have a tongue attached to the first edge and a groove attached to the second edge, the tongue and the groove each extending in a plane below the top surface downward from the top, the tongue being adapted to fit with a groove of an adjacent plank. The tongue and the groove are shaped so that a space is maintained between a portion of the tongue and a portion of the groove of the adjacent plank when the tongue is placed adjacent to the groove of the adjacent plank. A number of the deck planks can be used to make a deck.

29 Claims, 8 Drawing Sheets

DECK PLANK

This application is a continuation-in-part of U.S. application Ser. No. 08/752,813, filed Nov. 21, 1996, entitled DECK PLANK, now U.S. Pat. No. 5,836,128.

BACKGROUND OF THE INVENTION

The present invention relates generally to decks and more particularly to a deck plank having a tongue and a groove.

Wood is commonly used for decks. However, the use of wood for decks presents a number of problems. First, constant exposure to the elements can cause the wood to deteriorate over time. In order to prevent (or delay) this from happening, the wood must be treated with a wood preservative. Treating the wood can be a time consuming and messy process. Next, wood is frequently stained or painted to achieve a desired color, but the color can fade or chip and peel over time.

In addition, the dimensions of wood vary depending on the moisture content of the wood and the temperature. These variations can cause warping of the boards which can cause the surface of the deck to become uneven over time. Finally, when a tongue and groove arrangement of boards is used, if the head of the nail is not flush with the surface of the board, the next board will not fit against it properly, resulting in an uneven surface.

Therefore, it would be desirable to have an improved tongue and groove joint. It would also be desirable to have a deck plank having improved dimensional stability and decreased maintenance. The deck plank should be easy to install. The design of the deck plank should ensure that the deck will be smooth and even when installed.

DESCRIPTION OF THE INVENTION

Figure 1:
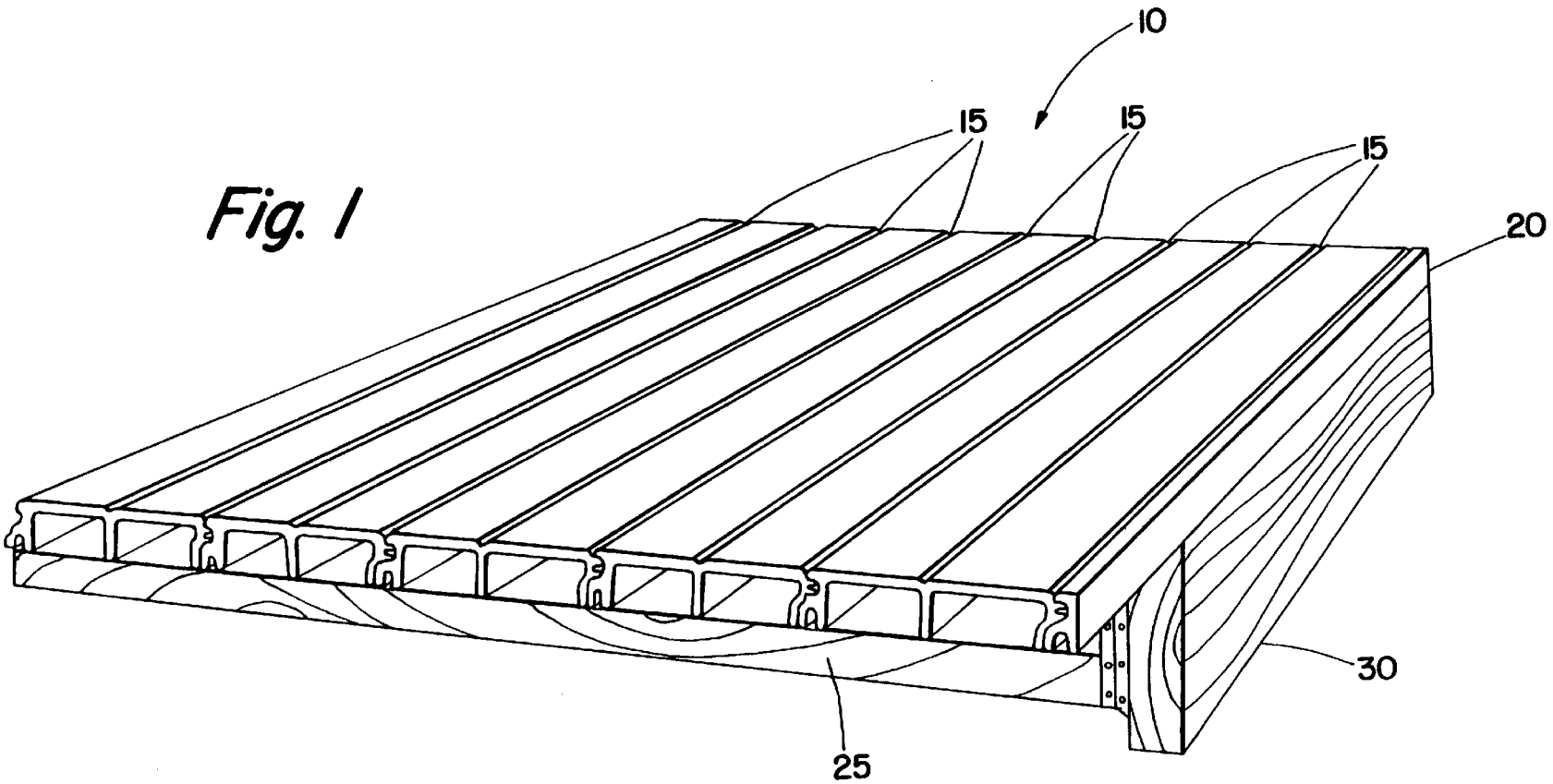
FIG. 1 is a perspective view of one embodiment of a deck of the present invention.

The present invention relates to a deck plank. In one embodiment, the deck plank includes a substantially flat top having a first edge and a second edge, a tongue attached to the first edge, the tongue extending in a plane below the top surface, and a groove attached to the second edge, the groove extending in a plane below the top, the tongue being adapted to fit within a groove of an adjacent plank. The plank is preferably made from a wood replacement material.

The tongue and the groove of the deck plank are preferably shaped so that a space is maintained between a portion of the tongue and a portion of the groove of the adjacent plank when the tongue is placed adjacent to the groove of the adjacent plank. Many different shapes for the tongue and groove design may be used, including curves and various complex shapes.

Preferably, the tongue has a first portion and an angled portion of a first angle and the groove has a first portion and an angled portion of a second angle, the first angle being sufficiently different from the second angle so that a space is maintained between the first angle and the second angle when the first portion of the tongue is placed adjacent to the first portion of the groove of the adjacent plank. The first angle can be greater or less than the second angle.

The tongue and groove preferably have an upper portion above the first portion, the upper portions being so shaped that a gap is maintained between the upper portion of the tongue and the upper portion of the groove of the adjacent plank when the first portion of the tongue is placed adjacent to the first portion of the groove of the adjacent plank.

The deck plank may include a support leg extending downward perpendicular to the top at a point intermediate between the first and second edges. The deck plank may also have a notch or groove in the top surface extending the length of the plank to provide an escape path for water that comes into contact with the plank surface.

The invention also relates to a deck plank comprising a substantially flat top surface having a first edge and a second edge, a tongue attached to the first edge, the tongue extending in a plane below the top surface, the tongue having a first portion and an angled portion of a first angle, and a groove attached to the second edge, the groove extending in a plane below the top, the groove having a first portion and an angled portion of a second angle, the tongue being adapted to fit within a groove of an adjacent plank, the first angle being sufficiently different from the second angle so that a space is maintained between the first angle and the second angle when the first portion of the tongue is placed adjacent to the first portion of the groove of the adjacent plank.

The deck plank of the present invention may be made from wood, plastics or from several other materials including wood replacement material. The wood replacement material may be a polymer, such as homopolymers and copolymers of polyethylene, polyvinyl chloride, polypropylene and ABS, or a mixture of these polymers. The wood replacement material preferably includes cellulose material for appearance, stiffness, and economics. The cellulose material may be in the form of fibers (e.g., wood flour and the like). The deck planks made from wood replacement materials are preferably extruded, using conventional plastics extrusion equipment and one or more dies to provide the desired cross section shape of each plank.

The invention further comprises a deck including a support, and at least one deck plank attached to the support. The deck preferably includes a starter strip attached to the support, the starter strip having a groove adapted to receive the tongue of the deck plank.

The invention also comprises a method of making a deck including providing a support, providing a first deck plank having a tongue and a groove, the tongue being adapted to fit within a groove of an adjacent plank, and attaching the first deck plank to the support. The method may also include providing a starter strip having a groove adapted to receive the tongue of the first deck plank, attaching the starter strip to the support, and placing the tongue of the first deck plank adjacent to the groove of the starter strip.

In yet another embodiment of the present invention, a surface mount deck plank is provided that does not include a tongue or groove. The surface mount unit has support legs similar to the tongue and groove embodiment.

FIG. 1 generally shows a deck 10 according to the present invention. The deck 10 is composed of a series of deck planks 15 and a starter strip 20. The deck is supported by a ledger 25 and joists 30 (only one shown) perpendicular to the ledger.

Figure 2:
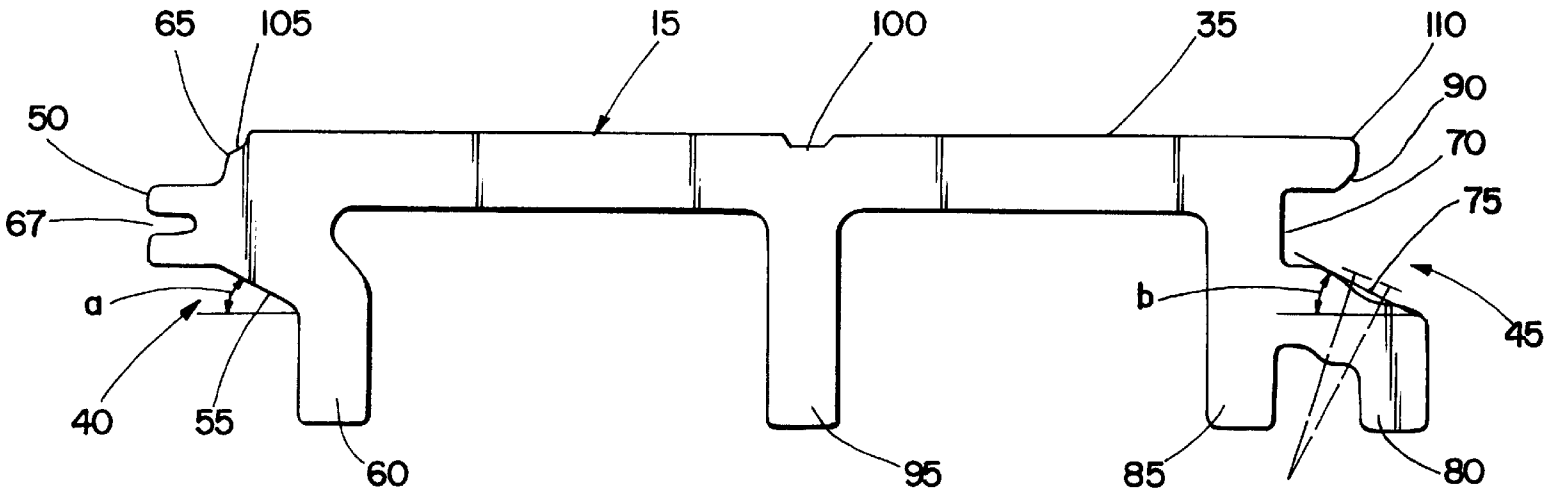
FIG. 2 is a cross-section of a deck plank of the present invention used in the embodiment of FIG. 1.

The deck plank 15 is shown in more detail in FIG. 2. The deck plank 15 has a horizontal top surface 35. The top of the deck plank, for example, may be approximately 0.375 inches thick. The surface of the top 35 is preferably roughened to provide better traction. The deck plank may be made in many lengths including a variety of standard lengths, e.g. 8, 10, and 12 foot lengths. The weight of the deck plank 15 is greatly reduced as compared to a solid plank due to the material reduction.

One edge of the deck plank has a tongue 40 and the opposite edge has a groove 45. The tongue has an extended portion 50, an angled portion 55, a lower portion 60, and an upper portion 65. The angled portion 55 extends from the lower portion 60 to the extended portion 50. The angle "a" of the angled portion 55 is measured relative to horizontal. The angle "a" is preferably approximately 25°.

The extended portion 50 has a horizontal slot 67. The horizontal slot 67 allows for expansion and contraction in the deck plank. If the planks expand, they can move horizontally. The horizontal slot 67 allows the part of the extended portion 50 below the horizontal slot 67 to compress upward while maintaining a tight fit between the upper edge of the extended portion 50 and the bottom of the upper portion of the groove of the adjacent plank.

The groove 45 preferably has a substantially vertical portion 70, an angled portion 75, a first lower portion 80, a second lower portion 85, and an upper portion 90. The angled portion 75 extends from the first lower portion 80 to the substantially vertical portion 70. The angle "b" of the angled portion 75 is measured relative to horizontal. The angle "b" of the groove is preferably more than the angle "a" of the tongue, and preferably is approximately 28°. The substantially vertical portion 70 extends substantially vertically upward from the end of the angled portion 75 to the upper portion 90. The first lower portion 80, the second lower portion 85, the angled portion 75, and the substantially vertical portion 70 preferably form a generally "h" shape. A fastener may be installed at the angled portion 75 to penetrate the first lower portion 80 and an underlying structure member 25 to thereby secure the deck plank 15 to the structure.

The deck plank 15 preferably has a vertical support leg 95. The vertical support leg 95 extends downward perpendicular from the top surface 35 of the deck plank. The vertical support leg 95 provides support for the top 35 of the deck plank. Above the vertical support leg 95 may be a notch or groove 100 in the top surface 35 which may extend the length of the deck plank.

A partial notch 105 is formed in the upper portion 65 of the tongue 40. The upper portion 90 of the groove 45 has a complementary portion 110 to a notch. When two deck planks are put together, the partial notch 105 of one deck plank is mated with the complementary portion 110 of the second plank to form a complete notch.

Figure 3:
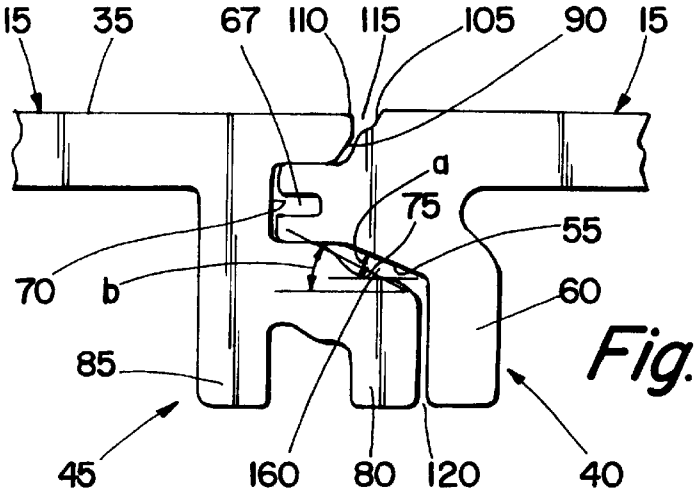
FIG. 3 is a partial view showing a cross-section of a tongue and groove joint between deck planks of one embodiment of the present invention.
Figure 16:
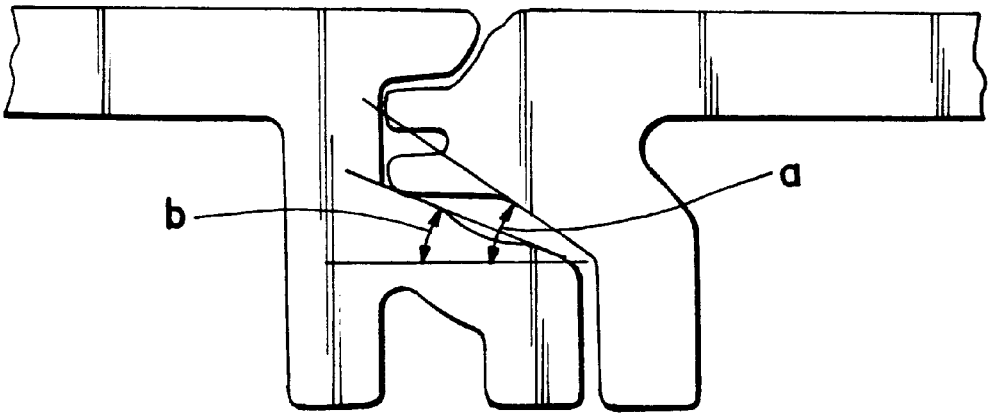
FIG. 16 is a partial view showing a cross-section of a tongue and groove joint between deck planks of another embodiment of the present invention.

FIG. 3 shows a joint between two deck planks in which the angle "b" is greater than the angle "a. "On the other hand, FIG. 16 shows an embodiment in which the angle "a" is greater than the angle "b." The tongue 40 of one deck plank is mated with the groove 45 of an adjacent plank. The extended portion 50 of the tongue is positioned adjacent to the substantially vertical portion 70 of the groove. The upper portion 90 of the groove is adjacent to the upper portion 65 of the tongue. The partial notch 105 of the upper portion 65 of the tongue and the complementary portion 110 of the upper portion 90 of the groove form a complete notch.

There is a gap 115 between the upper portion 65 of the tongue and the upper portion 90 of the groove of the adjacent plank below the partial notch 105 and the complementary portion 110. Water which flows into the notch continues downward into the gap 115. From there, the water flows horizontally along the gap 115 to vertical slits in the tongue of the plank (not shown in FIG. 3). The water then flows down through the vertical slits and out the bottom of the plank through the space 120. The space 120 is maintained between the angled portion 55 of the tongue and the angled portion 75 of the groove due to the difference between the angles a and b.

The deck planks may be made in different widths, e.g. 6 inch and 12 inch widths, and may have different numbers of notches. The notches in the top provide the deck plank with the look of a series of smaller boards. For instance, if the deck plank is approximately 6 inches in width with one notch, it appears to be two 3 inch boards. A 12 inch deck plank with three notches appears to be four boards of about 3 inches each. However, rather than having to nail four boards per foot of decking, the 6 inch deck plank would require only two nails per foot, while the 12 inch deck plank requires only one nail.

Figure 4:
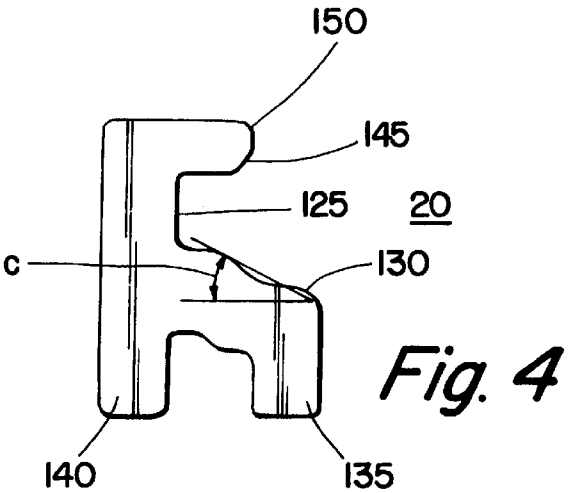
FIG. 4 is a cross-section of a starter strip of one embodiment of the present invention.

The starter strip 20 is shown in FIG. 4. The starter strip 20 has a substantially vertical portion 125, an angled portion 130, a first lower portion 135, a second lower portion 140, and an upper portion 145. The upper portion 145 has a complementary portion 150 of a notch. The angle "c" of the angled portion 1 30 is measured relative to horizontal. The angle "c" is preferably about the same as angle "b".

Figure 5:
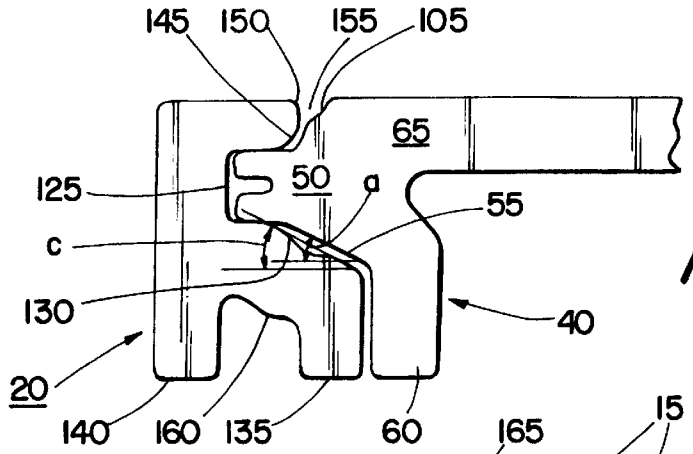
FIG. 5 is a partial view showing a cross-section of a tongue and groove joint between a deck plank and a starter strip of one embodiment of the present invention.
Figure 17:
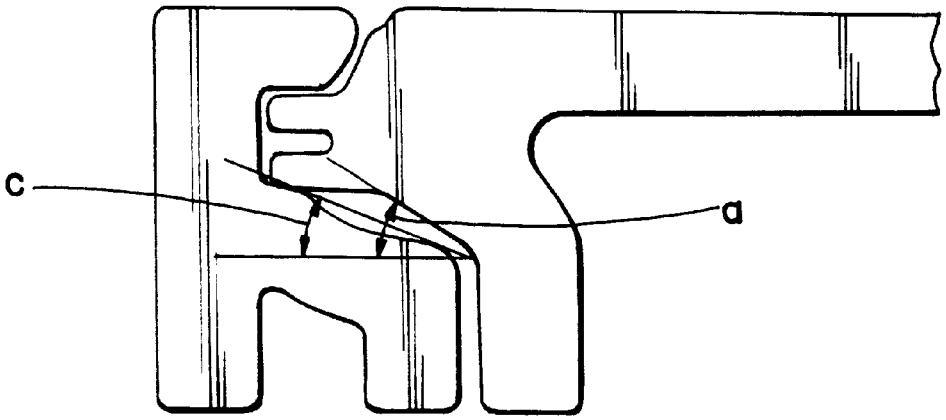
FIG. 17 is a partial view showing a cross-section of a tongue and groove joint between a deck plank and a starter strip of another embodiment of the present invention.

FIG. 5 shows a joint between a starter strip 20 and a deck plank 15 in which the angle "c" is greater than the angle "a." FIG. 17 shows another example of a joint in which the angle "a" is greater than the angle "c." The tongue 40 of the deck plank is mated with the starter strip 20. The extended portion 50 of the tongue is positioned adjacent to the substantially vertical portion 125 of the starter strip. The upper portion 145 of the starter strip is adjacent to the upper portion 65 of the tongue. The partial notch 105 of the upper portion 65 of the groove and the complementary portion 150 of the upper portion 145 of the starter strip form a complete notch. There is a gap 155 between the upper portion 65 of the tongue and the upper portion 145 of the groove of the adjacent plank below the partial notch 105 and the complementary portion 150. A space 160 is maintained between the angled portion 55 of the tongue and the angled portion 130 of the starter strip due to the difference between the angles "a" and "c". A fastener may be installed at the space 160 to penetrate the starter strip 20 and secure it to an underlying structure member.

Figure 6:
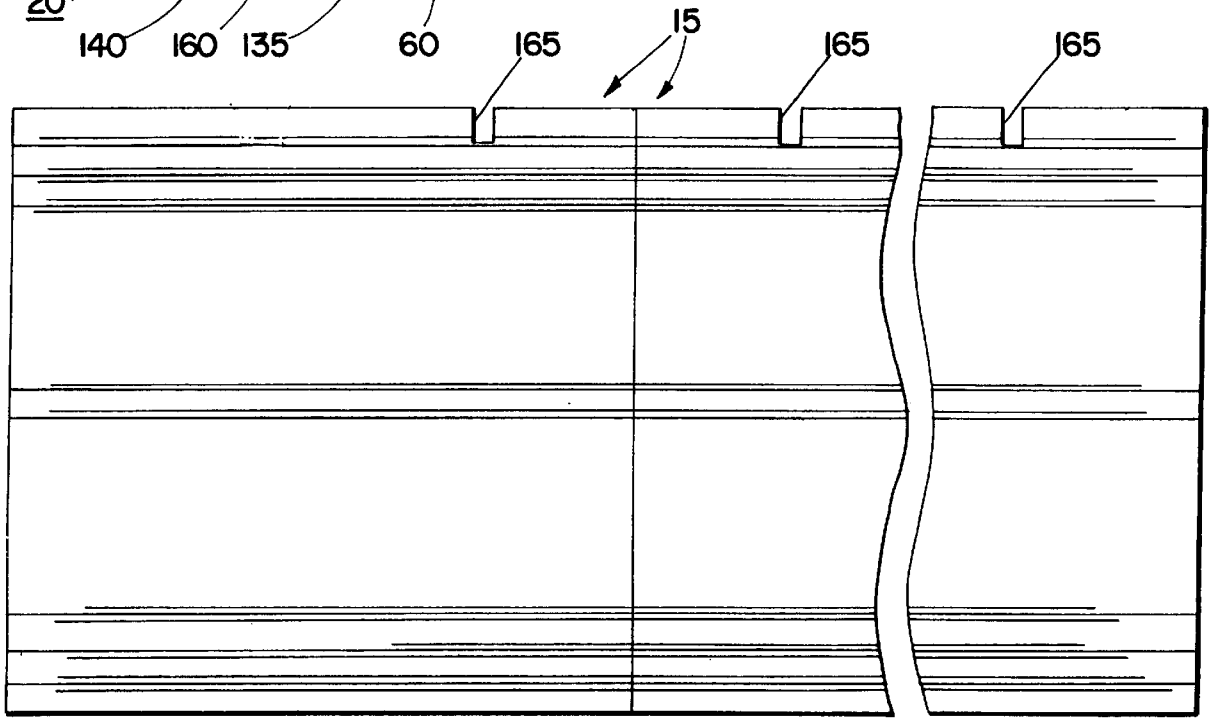
FIG. 6 is a top view of one embodiment of the deck plank of the present invention.
Figure 7:
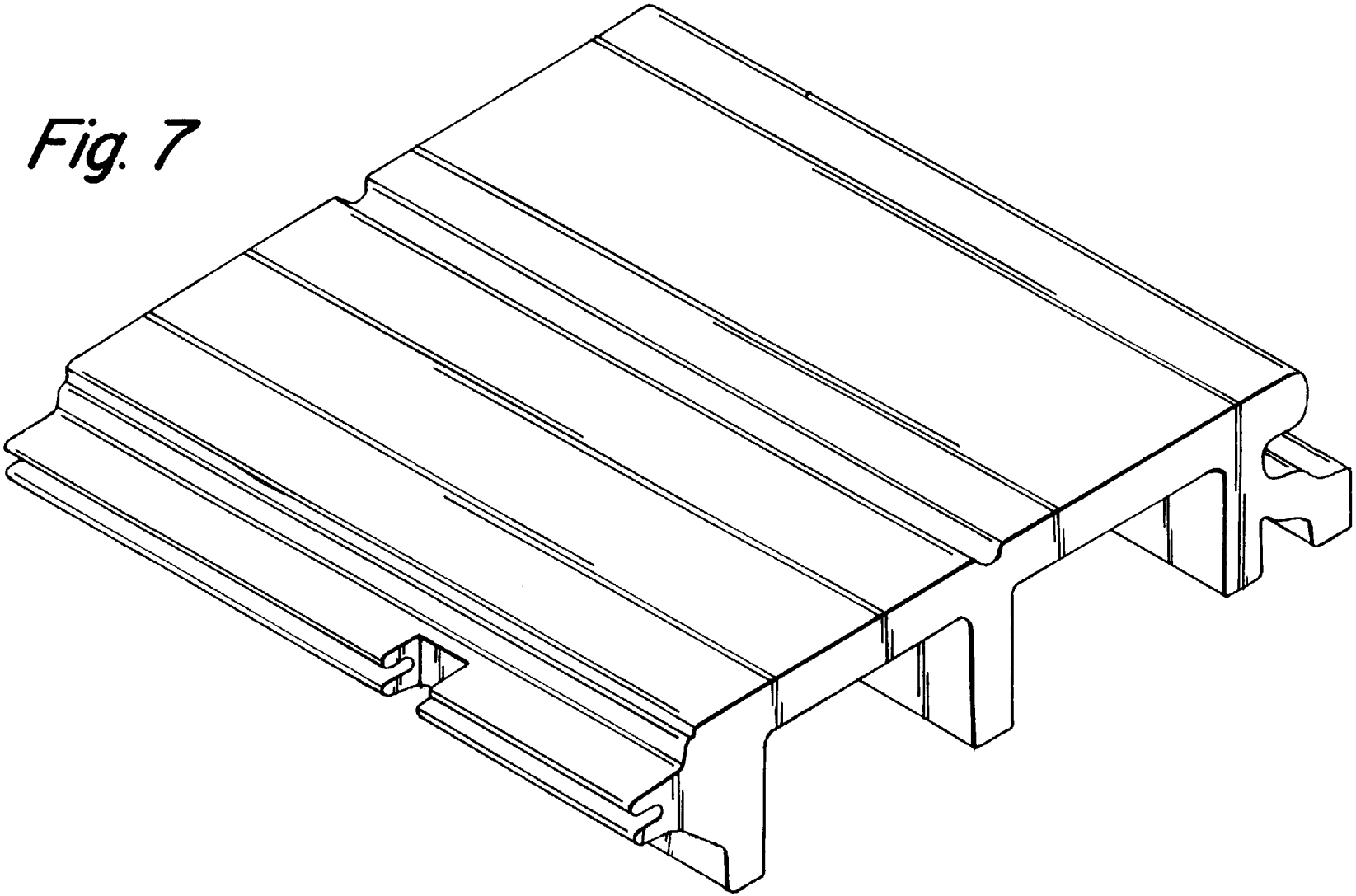
FIG. 7 shows a perspective view of one embodiment of the deck plank of the present invention.
Figure 8:
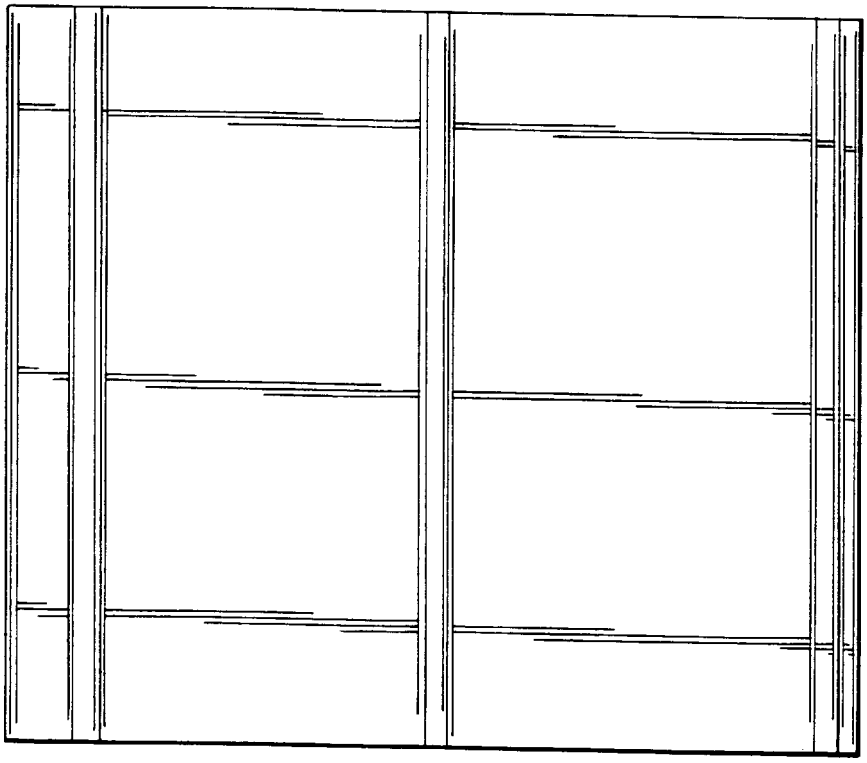
FIG. 8 shows a top plan view of the deck plank of FIG. 7.
Figure 9:
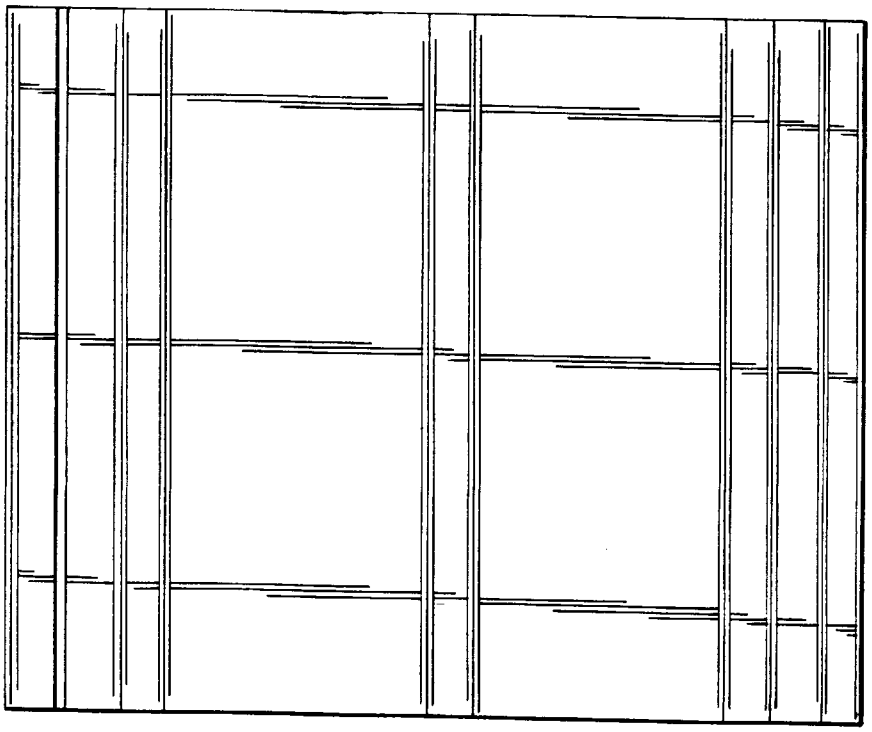
FIG. 9 shows a bottom plan view of the deck plank of FIG. 7.
Figure 10:
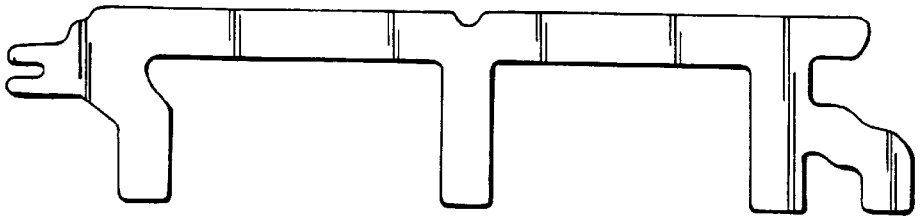
FIG. 10 shows a side elevation view of the deck plank of FIG. 7.
Figure 11:
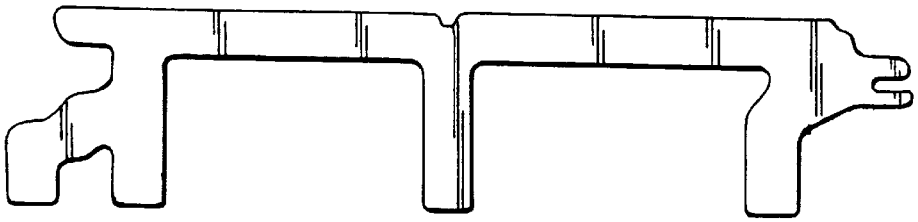
FIG. 11 shows an opposite side elevation view of the deck plank of FIG. 7.
Figure 12:
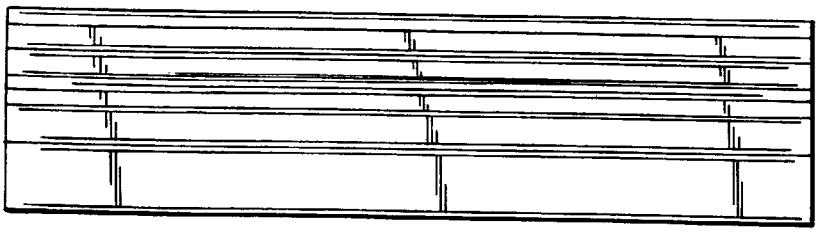
FIG. 12 shows an end view of the deck plank of FIG. 7.
Figure 13:
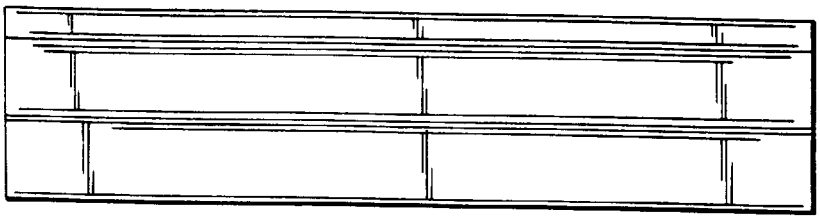
FIG. 13 shows an opposite end view of the deck plank of FIG. 7.

FIG. 6 shows a top view of the deck plank. The deck plank has a series of vertical slits 165 in the tongue. The vertical slits 165 extend through the substantially vertical portion of the tongue. The vertical slits 165 may be placed at different locations along the length of the plank, for example, every twelve inches. Water which flows into the joint between the tongue of one plank and the groove of the next may flow downward through the vertical slits 165 and out through the angled portions on the bottom of the plank. The combination of the gap 115 (and 155), the vertical slits 165, and the space 120 (and 160), which allows water to flow downward through the joints between the deck planks, helps reduce the buildup of water on the surface of the deck.

The deck of the present invention may be made as follows. The starter strip 20 is nailed, screwed, stapled or otherwise attached to the ledger 25 at intervals along its length. The nails (or other attachments) extend through the angled portion 130 of the starter strip into the ledger. A deck plank 15 is then placed next to the starter strip. The extended portion 50 of the deck plank is positioned adjacent to the substantially vertical portion 125 of the starter strip. The space 160 between the angled portion 130 of the starter strip and the angled portion 55 of the tongue allows room for nails which are not flush with the surface of the angled portion 130. This provides a smooth, even fit between the starter strip and the deck plank even if the head of the fastener extends upward slightly from the surface of the angled portion 130.

The deck plank is then fastened to the joists 30 along its length. The deck plank is nailed, or otherwise fastened, through the angled portion 75 of the groove. A second deck plank may then be placed into position, and the process repeated. The space 120 between the angled portion 75 of the groove of the first deck plank and the angled portion 55 of the tongue of the second deck plank again allows room for the head of nails or other fasteners which may extend upward slightly from the surface of the angled portion 75.

FIGS. 7 through 13 need no further discussion as they are merely design drawings of the deck plank of FIG. 2 described above.

Figure 14:
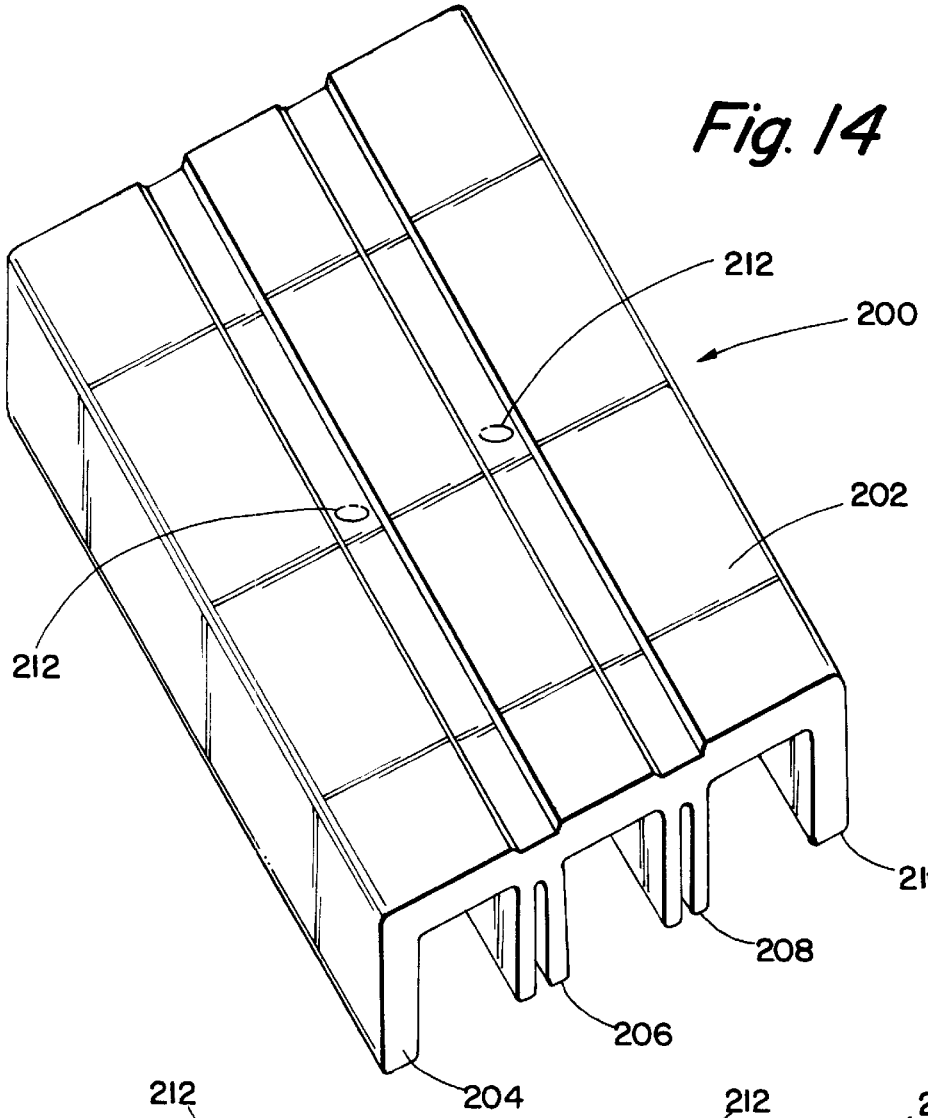
FIG. 14 shows a perspective view of another embodiment of a deck plank of the present invention.
Figure 15:
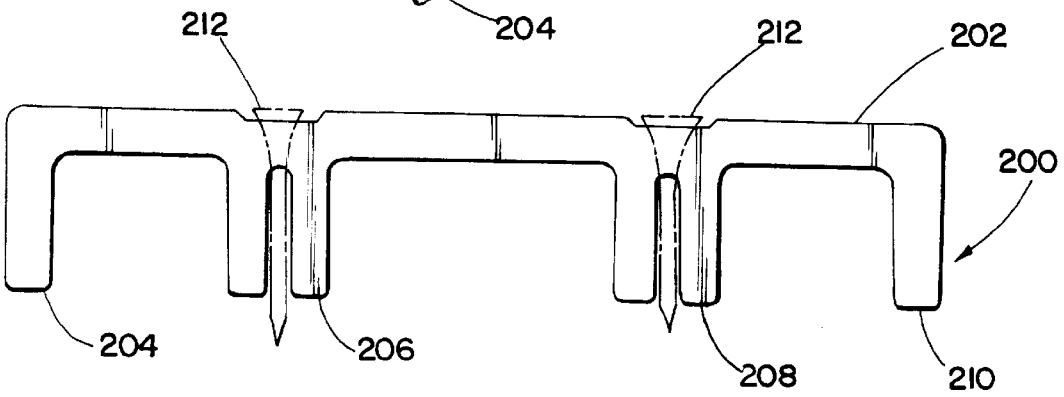
FIG. 15 shows a cross-section view of the deck plank of FIG. 14.

FIGS. 14 and 15 show another embodiment of the present invention which is manufactured and installed in similar fashion to the embodiment described above. A deck plank 200 is shown with the top surface 202 and support legs 204, 206, 208, 210. Fasteners 212 may be installed through the top surface 202 between split members of legs 206, 208. This embodiment does not include a tongue and groove approach. Instead, planks 200 are installed side-by-side abutting adjacent planks, and may be secured to structure as the tongue and groove embodiment was shown to be in FIG. 1.

An example formulation for the material composition of the deck planks of the present invention is set forth below. However, it is to be recognized that the present invention may be made with the use of many materials, and it is believed to be unique apart from material considerations.

| | |
|---|---|
| Wood Flour | 50% |
| HDPE | 45% |
| Zinc Stearate | 2.5% |
| Wax | 2.5% |

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A deck plank comprising:

a substantially flat top surface having a first edge and a second edge;

a tongue attached to the first edge, the tongue having an expansion gap and an angled portion of a first angle;

a groove attached to the second edge, the groove having an angled portion of a second angles the tongue being adapted to fit with a groove of an adjacent plank; and at least two support legs extending from said top surface forming at least one open area beneath said top surface;

wherein said plank is extruded from a wood replacement material; and wherein the first angle is sufficiently different from the second angle so that a space is maintained between the first angle and the second angle when the tongue is fit with the groove of the adjacent plank.

2. The deck plank of claim 1 wherein the plank includes a polymer.

3. The deck plank of claim 1 wherein the plank includes cellulose material.

4. The deck plank of claim 1 wherein the plank is adapted to be installed with surface-mounted fasteners.

5. The deck plank of claim 4 wherein the fasteners are nails.

6. A deck plank comprising:

a substantially flat top surface made from a wood replacement material having a first edge and a second edge;

a tongue attached to the first edge, the tongue having an expansion gap, the tongue extending in a plane below the top surface, the tongue having a first portion and an angled portion of a first angle; and a groove attached to the second edge, the groove extending in a plane below the top surface, the groove having a first portion and an angled portion of a second angle, the tongue being adapted to fit with a groove of an adjacent plank;

wherein the first angle is sufficiently different from the second angle so that a space is maintained between the first angle and the second angle when the first portion of the tongue is placed adjacent to the first portion of the groove of the adjacent plank.

7. The deck plank of claim 6 further comprising a support leg extending downward perpendicular to the top at a point intermediate between the first and second edges.

8. The deck plank of claim 6 wherein the top has a notch or groove extending the length of the plank.

9. The deck plank of claim 6 wherein the deck plank is extruded.

10. The deck plank of claim 6 wherein the first angle is greater than the second angle.

11. The deck plank of claim 6 wherein the second angle is greater than the first angle.

12. The deck plank of claim 6 wherein the first portion of the tongue is substantially vertical.

13. The deck plank of claim 6 wherein the first portion of the groove is substantially vertical.

14. The deck plank of claim 6 wherein the expansion gap is a horizontal slot.

15. The deck plank of claim 6 wherein the tongue has an upper portion above the first portion and the groove has an upper portion above the first portion, the upper portion of the tongue and the upper portion of the groove being so shaped that a gap is maintained between the upper portion of the tongue and the upper portion of the groove of the adjacent plank when the first portion of the tongue is placed adjacent to the first portion of the groove of the adjacent plank.

16. The deck plank of claim 6 wherein the tongue has a vertical slit.

17. The deck plank of claim 16 wherein the first portion of the tongue has the vertical slit.

18. The deck plank of claim 6 wherein the wood replacement material comprises a polymer.

19. The deck plank of claim 18 wherein the polymer is selected from homopolymers and copolymers of polyethylene and homopolymers and copolymers of polyvinyl chloride and mixtures thereof.

20. The deck plank of claim 18 wherein the wood replacement material further comprises a cellulose material.

21. The deck plank of claim 20 wherein the cellulose material is wood flour.

22. A deck comprising:

a support; and at least a first and a second deck plank made from a wood replacement material and attached to the support, each of the deck planks comprising:

a substantially flat top surface made from a wood replacement material having a first edge, a second edge, and an open area beneath said top surface;

a tongue attached to the first edge, the tongue having an expansion gap, the tongue extending in a plane below the top surface the tongue having an angled portion of a first angle; and a groove attached to the second edge, the groove extending in a plane below the top surface, the groove having an angled portion of a second angle, the tongue of the first deck plank positioned in the groove of the second deck plank;

wherein the first angle is sufficiently different from the second angle so that a space is maintained between the first angle and the second angle.

23. The deck of claim 22 further comprising a starter strip made from a wood replacement material attached to the support, the starter strip having a groove receiving the tongue of the second deck plank.

24. The deck of claim 22 further comprising a starter strip made from a wood replacement material attached to the support, the starter strip having a groove shaped so that a space is maintained between a portion of the tongue of the second deck plank and a portion of the groove of the starter strip when the tongue of the second deck plank is placed adjacent to the groove of the starter strip.

25. The deck of claim 22 further comprising a starter strip made from a wood replacement material attached to the support, the starter strip having a groove having a first portion and an angled portion of a third angle, the tongue of the second deck plank having a first portion and the angled portion of the first angle the first angle being sufficiently different from the third angle so that a space is maintained between the angled portion of the tongue of the second deck plank and the angled portion of the starter strip when the first portion of the tongue of the second deck plank is placed adjacent to the first portion of the groove of the starter strip.

26. The deck of claim 25 wherein the first angle is greater than the third angle.

27. The deck of claim 25 wherein the first angle is less than the third angle.

28. A method of making a deck comprising:

providing a support structure;

providing a first and a second deck plank, each including a substantially flat top surface made from a wood replacement material having a first edge, a second edge, and an open area beneath said top surface, a tongue being attached to the first edge, the tongue having an expansion gap and an angled portion of a first angle, a groove being attached to the second edge, the groove having an angled portion of a second angle, the tongue being adapted to fit with a groove of an adjacent plank;

attaching said first deck plank to the support structure; and attaching said second deck plank to said support structure adjacent said first deck plank;

wherein the tongue of the first deck plank is adjacent to the groove of the second deck plank, and the first angle is sufficiently different from the second angle so that a space is maintained between the first angle and the second angle.

29. The method of claim 28 wherein said attaching is accomplished with fasteners inserted through said top surface of said first and second planks.

* * * * *

UNITED STATES PATENT AND TRADEMARK OFFICE
CERTIFICATE OF CORRECTION

PATENT NO: 6,131,355

DATED: October 17, 2000

INVENTOR(S): Groh, et al.

It is certified that error appears in the above-identified patent and that said Letters Patent is hereby corrected as shown below:

In column 2, line 2, please delete "14," and replace it with -- 14; --.

In column 4, line 58, please delete "1 30" and replace it with -- 130 --.

In column 6, above the table in line 5, please insert the following table heading, centered above the table line -- Example Formulation (By Weight) --.

In column 6, line 23, please delete the word "angles" and replace it with -- angle, --.

In column 7, line 41, after "below the tope of the surface", please insert -- , --.

In column 8, line 17, after "portion of the first angle", please insert -- , --.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*